US006675537B2

(12) United States Patent
Morton et al.

(10) Patent No.: US 6,675,537 B2
(45) Date of Patent: Jan. 13, 2004

(54) DOUBLE HUNG PLASTIC WINDOW FRAME

(75) Inventors: Philip G. Morton, Germantown, OH (US); Ricky Hoskins, Franklin, OH (US); David A. Stammen, Dayton, OH (US); Jonathan C. Hauberg, Beavercreek, OH (US)

(73) Assignee: Dayton Technologies, L.L.C., Monroe, OH (US)

( * ) Notice: Subject to any disclaimer, the term of this patent is extended or adjusted under 35 U.S.C. 154(b) by 0 days.

(21) Appl. No.: 10/306,595

(22) Filed: Nov. 27, 2002

(65) Prior Publication Data

US 2003/0079412 A1 May 1, 2003

Related U.S. Application Data

(63) Continuation of application No. 09/710,671, filed on Nov. 9, 2000, now abandoned.

(51) Int. Cl.[7] ..... E06B 1/04
(52) U.S. Cl. ..... 49/504
(58) Field of Search ..... 49/501, 504; 52/656.2, 52/656.5, 656.7, 656.9; D25/124

(56) References Cited

U.S. PATENT DOCUMENTS 4,483,099 A * 11/1984 Schmidt ..... 49/63
4,944,118 A * 7/1990 Biro ..... 49/504
5,099,624 A * 3/1992 Valentin ..... 52/207
5,274,955 A * 1/1994 Dallaire et al. ..... 49/406
5,555,682 A * 9/1996 Colitto ..... 52/100
5,557,894 A * 9/1996 Card ..... 49/504
5,572,839 A * 11/1996 Kinsey ..... 52/204.51
6,055,782 A * 5/2000 Morton et al. ..... 52/204.1
D461,256 S * 8/2002 Ballard et al. ..... D25/124
D467,355 S * 12/2002 Ballard et al. ..... D25/124
6,490,839 B1 * 12/2002 Macquart et al. ..... 52/656.5

* cited by examiner

*Primary Examiner*—Jerry Redman
(74) *Attorney, Agent, or Firm*—Jacox, Meckstroth & Jenkins

(57) ABSTRACT

A double hung window assembly includes a rectangular frame formed by a pair of vertical jamb members connected by a horizontal sill member and a horizontal head member. Each of the members comprises a one-piece extrusion of rigid plastics material, and the members are rigidly connected with upper and lower welded mitered corner joints. The jamb and sill members have outer walls for the rough window opening and laterally spaced inner sloping walls which mate at the bottom corner joints. The jamb members also have inner channel walls spaced laterally inwardly of the corresponding sloping walls to define channels for receiving hardware for upper and lower sash frames each including extrusions of rigid plastics material. The one-piece head member has an outer wall integrally connected to a laterally inwardly spaced inner wall and channel walls which mate with the corresponding outer walls and inner channel walls of the jamb members at the upper corner joints, and the inner channel walls of the head member receive the upper sash frame.

8 Claims, 2 Drawing Sheets

DOUBLE HUNG PLASTIC WINDOW FRAME

RELATED APPLICATIONS

This application is continuation of application Ser. No. 09/710,671 filed Nov. 9, 2000 now abandoned, and claims the benefit of the disclosures and filing date of design patent applications Ser. Nos. 29/122,732, 29/122,755, 29/122,756, and 29/122,757 all filed May 2, 2000.

BACKGROUND OF THE INVENTION

In a double hung window assembly constructed from extrusions of rigid plastics material such as rigid polyvinylchloride, and of the general type disclosed in U.S. Pat. No. 4,941,288 which issued to the assignee of the present invention, it is desirable for the fabricated rectangular window frame to be designed and constructed so that the frame has upper and lower welded mitered corner joints to provide the frame with substantial strength. It is also desirable for the window frame to have uniform exterior and interior appearances around the head and jamb members of the frame and to be fabricated with minimum or no notching at the corners and with only 45° miter cuts on the ends of each extrusion in order to simplify the fabrication of the window assembly. It is further desirable for the window frame to have sill, head and jamb members each formed from a single plastic extrusion and with the minimum weight of plastics material in each member and with maximum strength so that the fabricated window frame has a maximum strength/weight ratio.

SUMMARY OF THE INVENTION

The present invention is directed to an improved frame for a double hung window assembly and having a pair of vertical jamb members connected by a horizontal sill member and a horizontal head member and which provides all of the desirable advantages mentioned above. Each of the members is formed from a one-piece extrusion of rigid plastics material, with the jamb members both formed from the same extrusion. The head member and each of the jamb members are constructed to provide welded mitered upper corner joints without notching and with the welds at the mitered corners providing substantial joint strength. The one-piece head member also provides substantial savings in plastics material and has the same exterior appearance and the same interior appearance as the jamb members, thereby providing the window frame with a uniform appearance along jamb and head members.

Other features and advantages of the invention will be apparent from the following description, the accompanying drawings and the appended claims.

DESCRIPTION OF THE PREFERRED EMBODIMENT

Figure 1:
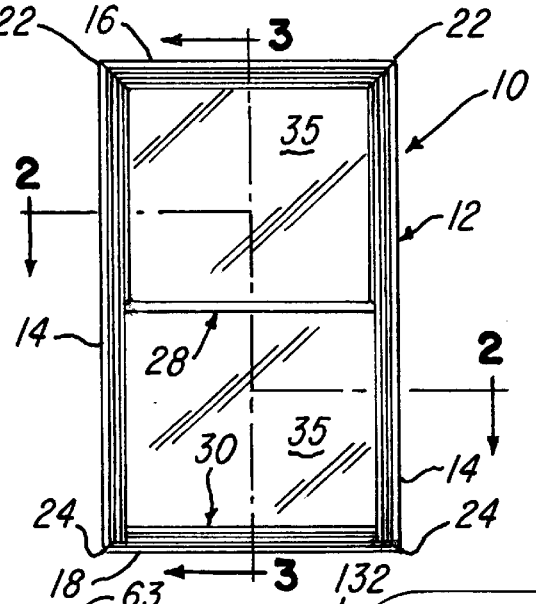
FIG. 1 is an elevational view of a double hung window assembly constructed in accordance with the invention.

FIG. 1 illustrates a double hung window assembly 10 which includes a rectangular window frame 12 formed by a pair of vertical jamb members 14 connected by a horizontal head member 16 and a horizontal sill member 18. The frame members 14, 16 and 18 are formed from extrusions of rigid plastics material such as rigid polyvinylchloride, with the extruded sections having 45° mitered ends and rigidly connected by welded mitered upper corner joints 22 and lower corner joints 24. The window assembly 10 also includes a rectangular upper sash frame 28 and a lower sash frame 30, with each sash frame fabricated or formed of extruded sections or members of rigid plastics material and having welded mitered corner joints. Each of the sash frames 28 and 30 encloses a dual insulated glazing unit 35 each formed having parallel spaced transparent glass panes 38 bonded together by a resilient bonding material 42 surrounding an aluminum spacer frame 44, in a conventional manner. An extruded plastic removable glazing bead 46 surrounds each glazing unit 35 and secures the glazing unit to the corresponding rails of the sash frame 28 and 30. The detail construction and assembly of each sash frame 28 and 30 form no part of the present invention, and the construction and assembly is apparent from FIGS. 2 and 3.

Figure 2:
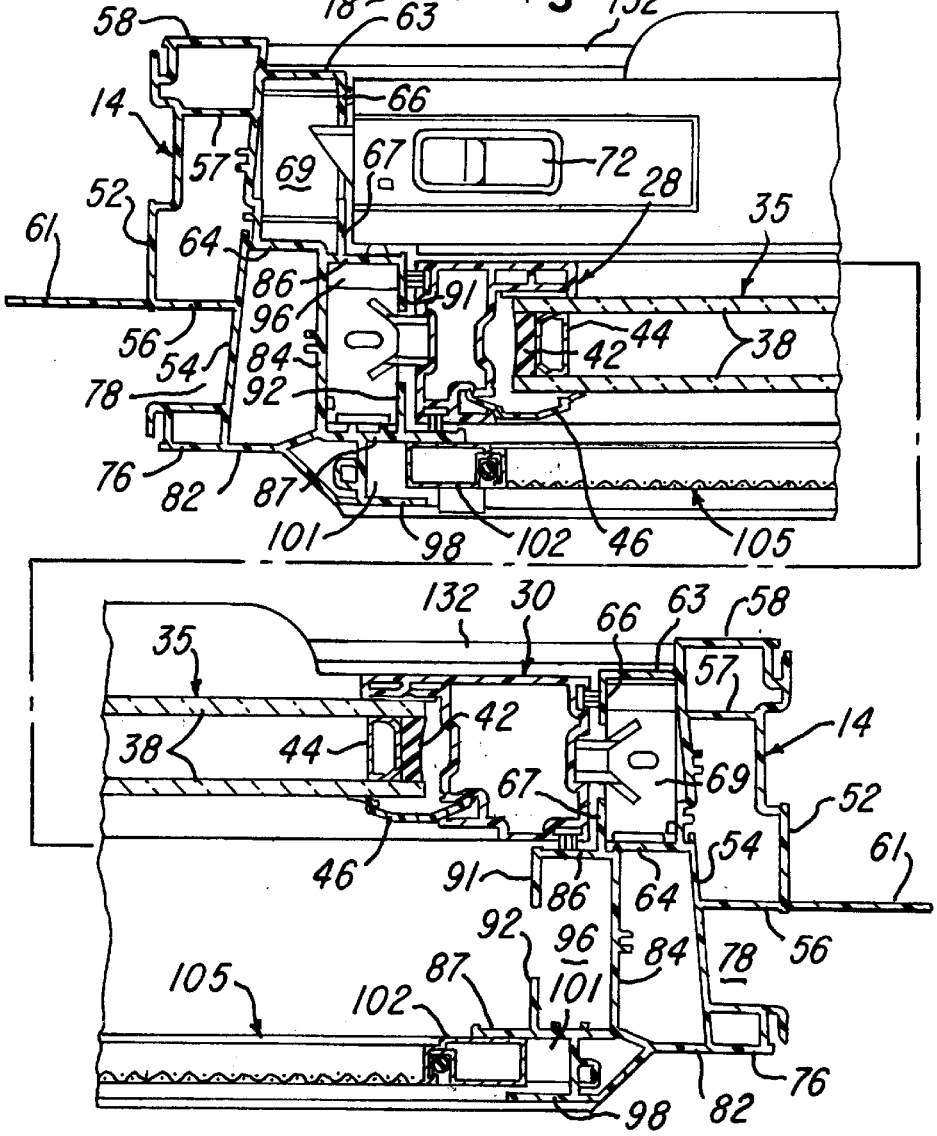
FIG. 2 is a section taken generally on the line 2—2 of FIG. 1 and with a center portion broken away.

Referring to FIG. 2, each of the one-piece jamb members 14 includes an outer wall 52 and a non-parallel inner sloping wall 54 which are integrally connected by laterally extending parallel spaced walls 56, 57 and 58. An optional nailing flange 61 projects laterally outwardly from the outer wall 52 as a continuation of the wall 56. Each jamb member 14 also includes inner channel walls 63 and 64 having opposing co-planar flanges or channel walls 66 and 67 which cooperate to define a chamber or channel 69 for receiving the sliding hardware (not shown) which pivotally supports the vertically lower sash frame 30. The channel 69 also receives a retractable latch mechanism 72 which is mounted on the top rail of the lower sash frame 30 and provides for pivoting the sash frame.

As also shown in FIG. 2, the sloping wall 54 of each jamb member 14 projects to the exterior of the wall 56 and integrally connects with a double wall outer flange 76 to define a longitudinally extending chamber or channel 78 adapted to receive the edge portions of exterior decorative siding (not shown) attached to the wall surface which also receives the nailing flange 61. The wall 82 projects laterally inwardly from the sloping wall 54 and is integrally connected to the channel wall 64 by another channel wall 84 which extends parallel to the outer wall 52. Channel walls 86 and 87 project laterally inwardly from the channel wall 84 and have co-planar flanges or walls 91 and 92 which cooperate to define a chamber or channel 96 for receiving the sliding support and sash counterbalance hardware (not shown) for the upper sash frame 28. An L-shaped channel wall 98 is also formed as an integral part of each jamb member 14 and defines a recess or channel 101 for receiving a rectangular aluminum frame 102 of a screen assembly 105.

Figure 3:
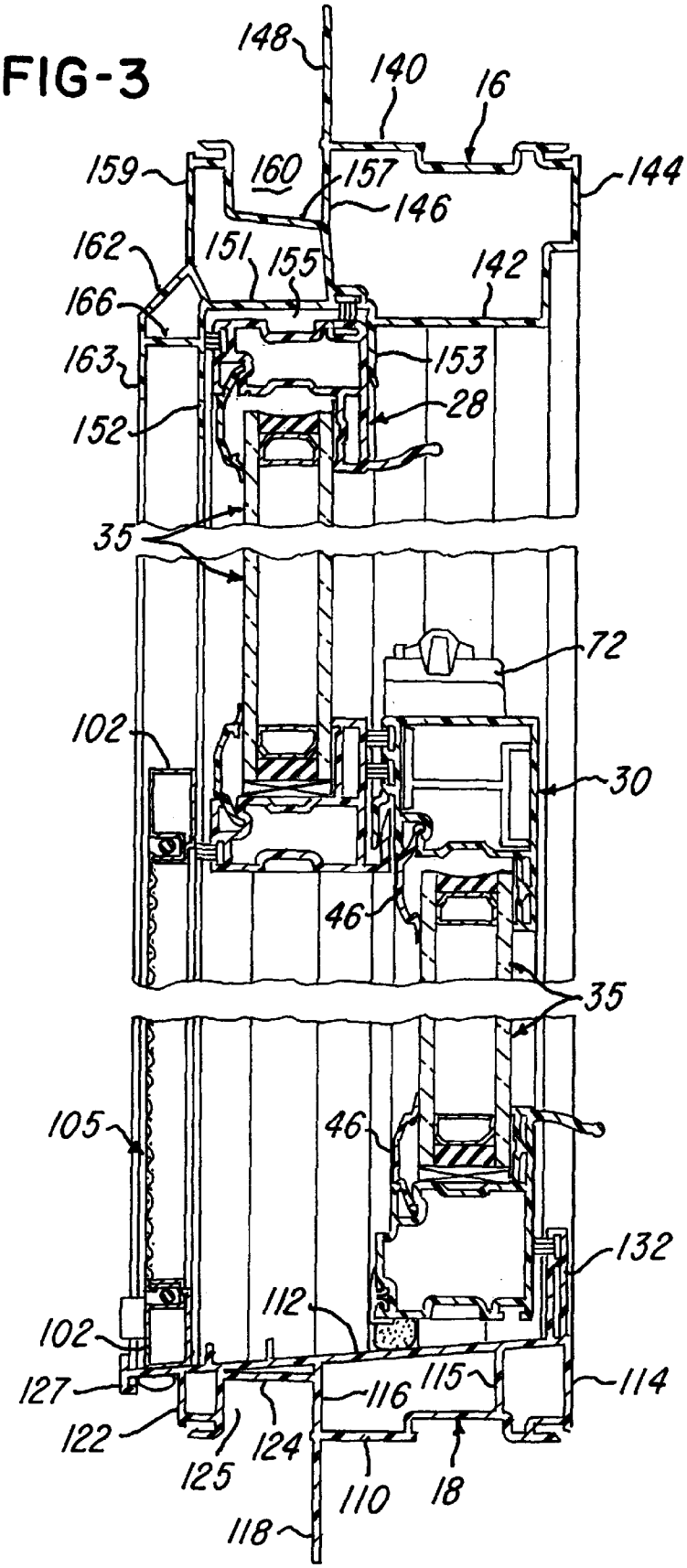
FIG. 3 is a vertical section of the window assembly taken generally on the line 3—3 of FIG. 1 and with upper and lower portions of the assembly broken away.

Referring to FIG. 3, the one-piece sill member 18 of rigid plastics material includes an outer wall 110 which seats within a rough window opening (not shown), and the wall 110 is integrally connected to an inner sloping wall 112 by laterally extending parallel spaced walls 114, 115 and 116. An optional nailing flange 118 projects laterally outwardly from the outer wall 110 and forms an extension of the wall 116. The sloping wall 112 extends outwardly from the exterior of the nailing flange 118 to a double wall flange 122. The wall 112 is reinforced by a wall 124 which cooperates with the wall 116 and flange 118 to define a longitudinally extending recess or channel 125 for receiving the edge portions of exterior decorative siding (not shown) in the same manner as described above for the channel 78. The sloping wall 112 of the sill member 18 extends outwardly past the double wall flange 122 to a drip edge or lip 127 and forms a support for the frame 102 of the screen 105. The one-piece sill member 18 also includes an interior double wall flange 132 which projects laterally inwardly and overlies the bottom rail of the lower sash frame 30.

As also shown in FIG. 3, the one-piece head member 16 of the window frame 12 includes and outer wall 140 and a laterally inwardly parallel spaced wall 142 integrally connected by a stepped inside wall 144 and a spaced outside wall 146. An optional nailing flange 148 projects laterally outwardly from the outer wall 140 in alignment with the wall 146, and the walls 142 and 146 are integrally connected to an inner channel wall 151. Parallel spaced channel walls 152 and 153 project laterally inwardly from the wall 151 to form a channel or pocket 155 for receiving the upper rail of the upper sash frame 28. An outer sloping wall 157 projects outwardly to the exterior from the wall 146 and integrally connects with a double wall flange 159 to define a channel 160 forming a continuation of the channels 78 and 125 to complete the channel around the frame 12. The flange 159 is integrally connected to the wall 151 by an internal reinforcing wall 162, and channel walls 163 and 166 cooperated with the channel wall 152 to define a pocket or channel for receiving the upper rail of the screen frame 102 when the sliding screen unit 105 is lifted upwardly in front of the upper sash frame 28.

It is apparent from FIGS. 2 and 3 that the 45° miter cuts on opposite ends of the head member 16 produces inner and outer peripheral walls which mate at the upper frame corners 22 with the inner and outer peripheral walls formed by the 45° miter cuts on the upper ends of the jamb members 14. More specifically, the walls 52, 56 and 58, a portion of the sloping wall 54 and the flanges 61 and 76 of each jamb member 74 mate with the walls 140, 144, 146 and 157 and the flanges 148 and 159 of the head member 16 to provide for continuous welded outer peripheral walls for the corner joints 22. In addition, the channel walls 63, 66, 97 and channel walls 84, 86, 87, and 98 of each jamb member 14 mate with the inner wall 142 and channel walls 151, 152, 153, 163 and 166 of the head member 16 to provide continuous welded inner peripheral walls at the upper mitered corners 22 of the window frame 12. As a result, welded mitered upper corner joints 22 of high strength are obtained from the one-piece head member 16 and each of the one-piece jamb members 14.

In addition, the jamb members 14 and the head member 16 provide a uniform exterior appearance and a uniform interior appearance around the window frame 12. The one-piece head member 16 also provides a channel or pocket 155 for the upper rail of the upper sash frame 28 and eliminates the need for a two-piece head member 16 such as disclosed in above-mentioned U.S. Pat. No. 5,941,288. Thus the construction of the head member 16 significantly reduces the plastics material within the head member 16 while providing substantial strength. For example, the construction or profile of the head member 16 provides about a 20% material savings for the head member in comparison to a two-piece head member thereby saves about 8–10% material on the entire frame 12. It is also apparent that only 45° mitered cuts are required to connect the head member 16 to each of the jamb members 14 without requiring any notching of the head member or jamb members. This significantly reduces the fabrication time and effort for producing the window frame 12 and thereby significantly reduces the cost for producing the window frame.

It is also apparent from the cross-section or profile of the sill member 18 and the cross-section or profile of each jamb member 14 that the 45° mitered cuts for the bottom corner joints 24 results in the sloping wall 54 and all of the laterally outer walls of each jamb member mating with the sloping wall 112 and all of the laterally outer walls of the sill member 18. As a result, a high strength welded mitered corner joint 24 is obtained between the sill member and each of the jamb members 14. As shown in FIG. 1, only the walls which project laterally inwardly of the sloping wall 54 of each jamb member 14 require a notching cut at the bottom corners 24 to mate with the top surface of the sill member 18.

While the form of frame assembly herein described constitutes a preferred embodiment of the invention, it is to be understood that the invention is not limited to this precise form of frame assembly, and that changes may be made therein without departing from the scope and spirit of the invention as defined in the appended claims.

What is claimed is:

1. A frame for a double hung window assembly, comprising a pair of vertical one-piece jamb members connected by a horizontal one-piece sill member and a horizontal one-piece head member, all of said members comprising extrusions of rigid plastics material joined together by upper and lower welded mitered corner joints, each of said one-piece sill and jamb members having an outer wall adapted to fit within a rough window opening with said outer wall integrally connected to corresponding laterally spaced inner sloping wall by laterally extending walls, said outer walls, said inner sloping walls and said laterally extending walls of said sill and jamb members mating at said lower welded mitered corner joints, each of said one-piece jamb members having two sets of integrally connected inner channel walls projecting laterally inwardly of the corresponding said inner sloping wall and having co-planar flanges to define two parallel channels adapted to receive hardware for supporting upper and lower sash frames, said one-piece head member including an outer wall adapted to fit within the rough window opening, said one-piece head member also including an inner wall and one set of integrally connected inner channel walls, said outer wall and said inner channel walls of said head member mating at said uppper mitered corner joints with the corresponding said outer wall and one set of said channel walls of each of said jamb members and said inner wall of said one-piece head member mating at said upper mitered corner joints with said co-planar flanges of the other said set of said channel walls of each of said jamb members to provide said upper welded mitered corner joints with substantial strength, and said one-piece head member cooperates with said one-piece sill member and each of said one-piece jamb members for significantly simplifying the assembly of said frame for a double hung window.

2. A frame as defined in claim 1 wherein each of said jamb, sill and head members defines a laterally outwardly facing peripheral channel projecting laterally inwardly from the corresponding said outer wall of each of said jamb, sill and head members, and said channels in said jamb, sill and head members are adapted to receive edge portions of exterior siding panels.

3. A frame as defined in claim 1 and including a peripherally extending nailing flange projecting laterally outwardly from said outer walls of said jamb, sill and head members.

4. A frame as defined in claim 1 wherein said one-piece head member includes generally parallel spaced walls defining a channel for receiving a screen frame.

5. A frame as defined in claim 1 wherein said inner wall of said head member define an unobstructed open space therebetween.

6. A frame as defined in claim 5 wherein said inner channel walls of said head member project laterally inwardly from said inner wall of said head member.

7. A frame as defined in claim 1 wherein said sill member comprises walls defining a laterally outwardly facing channel projecting laterally inwardly from said outer wall of said sill member and adapted for receiving edge portions of exterior siding panels.

8. A frame as defined in claim 7 wherein said walls defining said outwardly facing channel comprise a reinforcing wall parallel to said outer wall of said sill member adjacent said inner sloping wall, a double wall flange projecting laterally outwardly from said sloping wall, and a laterally extending wall integrally connecting said outer wall and said inner sloping wall and spaced from said double wall flange to define said outwardly facing channel.

* * * * *